US007314704B2

(12) United States Patent
Gore

(10) Patent No.: US 7,314,704 B2
(45) Date of Patent: Jan. 1, 2008

(54) IMAGE RECORDING MEDIA AND IMAGE LAYERS

(75) Inventor: Makarand P. Gore, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/256,852

(22) Filed: Oct. 24, 2005

(65) Prior Publication Data

US 2007/0092845 A1 Apr. 26, 2007

(51) Int. Cl.

| | |
|---|---|
| ***G03C 1/73*** | (2006.01) |
| ***G03C 1/735*** | (2006.01) |
| ***G03C 5/16*** | (2006.01) |
| ***B44M 5/20*** | (2006.01) |

(52) U.S. Cl. ..... 430/337; 430/338; 430/964; 503/209

(58) Field of Classification Search ..... 430/337, 430/338, 964; 503/209

See application file for complete search history.

(56) References Cited

U.S. PATENT DOCUMENTS

| | | | | |
|---|---|---|---|---|
| 3,293,055 | A | 12/1966 | Baum | |
| 4,502,066 | A * | 2/1985 | Satake et al. | 503/209 |
| 4,510,512 | A | 4/1985 | Okamoto et al. | |
| 4,590,499 | A * | 5/1986 | Fujimura et al. | 503/209 |
| 4,590,500 | A * | 5/1986 | Satake et al. | 503/209 |
| 4,630,080 | A * | 12/1986 | Satake et al. | 503/209 |
| 4,870,047 | A * | 9/1989 | Glanz et al. | 503/209 |
| 4,895,827 | A * | 1/1990 | Vervacke et al. | 503/210 |
| 5,164,357 | A * | 11/1992 | Bartman et al. | 503/209 |
| 5,384,303 | A * | 1/1995 | Nishimura et al. | 503/209 |
| 5,707,778 | A * | 1/1998 | Minami et al. | 430/270.1 |
| 2003/0153460 | A1* | 8/2003 | Morita et al. | 503/216 |
| 2004/0146812 | A1* | 7/2004 | Gore et al. | 430/343 |
| 2006/0078832 | A1* | 4/2006 | Gore et al. | 430/332 |

FOREIGN PATENT DOCUMENTS

WO WO 2006/038996 A 4/2006

* cited by examiner

*Primary Examiner*—Richard L. Schilling

(57) ABSTRACT

Imaging layers, image recording media, and methods of preparation of each, are disclosed.

25 Claims, 1 Drawing Sheet

IMAGE RECORDING MEDIA AND IMAGE LAYERS

BACKGROUND

Compositions that produce a color change upon exposure to energy in the form of light are of great interest in producing images on a variety of substrates. For example, labeling of optical storage media such as Compact Discs, Digital Video Discs or bluelaser discs (CD, DVD, or blue laser disc) can be routinely accomplished through screen-printing methods. While this method can provide a wide variety of label content, it tends to be cost ineffective for run lengths less than 300-400 discs because the fixed cost of unique materials and set-up are shared by all the discs in each run. In screen-printing, a stencil of the image is prepared, placed in contact with the disc and then ink is spread by squeegee across the stencil surface. Where there are openings in the stencil the ink passes through to the surface of the disc, thus producing the image. Preparation of the stencil can be an elaborate, time-consuming and expensive process.

In recent years, significant increases in use of CD/DVD discs as a data distribution vehicle have increased the need to provide customized label content to reflect the data content of the disc. For these applications, the screen-label printing presents a dilemma as discs are designed to permit customized user information to be recorded in standardized CD, DVD, or blue laser disc formats. Today, for labeling small quantities of discs, popular methods include hand labeling with a permanent marker pen, using an inkjet printer to print an adhesive paper label, and printing directly with a pen on the disc media which has a coating that has the ability to absorb inks. The hand printing methods do not provide high quality and aligning a separately printed label by hand is inexact and difficult.

It may therefore be desirable to design an optical data recording medium (e.g., CD, DVD, or blue laser disc) which can be individually labeled by the user easily and inexpensively relative to screen-printing while giving a high quality label solution. It may also be desirable to design an optical data recording medium that accepts labeling via multiple methods, thus reducing the amount of inventory necessarily carried by optical data recording merchants and end users.

A variety of leuco dye-containing compositions have been investigated for use on optical disks and other substrates. Leuco dye compositions include a leuco dye along with an optional activator and an infrared absorber. However, many of these compositions are insufficiently stable when exposed to oil during handling, and are not durable enough for practical use. For this and other reasons, the need still exists for optical storage media that have improved oil resistance.

SUMMARY

Briefly described, embodiments of this disclosure include image recording coating and methods of preparation of the recording medium. One exemplary embodiment of the image recording coating, among others, includes a substrate having a layer disposed thereon. The layer includes: a matrix; an activator; a color former, wherein the activator and color former are designed mix to form a dark mark; and a fixer compound, wherein the fixer compound is chosen to retard fading of the dark mark upon exposure to an oil.

Another exemplary embodiment of the image recording coating, among others, includes a substrate having a layer disposed thereon. The layer includes: a matrix; a phenolic developer; a calcium salt of an organic acid; a leuco dye, wherein the layer includes a color change that is produced when the radiation-absorbing compound absorbs radiation and initiates a reaction between the phenolic acid and the calcium salts of the organic acid and the leuco dye.

One exemplary embodiment of the method for preparing an image recording medium, among others, includes: providing a matrix, an activator, a color former, and a fixer compound; mixing the activator, the color former, and the fixer compound, in the matrix to form a matrix mixture; and disposing the matrix mixture onto a substrate, wherein the activator and color former are adapted to form a mark, and wherein the fixer compound is chosen to retard fading of the dark mark upon exposure to an oil.

Another exemplary embodiment of the method for preparing an image recording medium, among others, includes: providing a matrix, a radiation-absorbing compound, a phenolic compound and calcium salt of an organic acid, and a leuco dye, wherein the radiation-absorbing compound absorbing radiation and initiating a reaction between the phenolic compound, and calcium salt of the organic acid, and the leuco dye to produce a color change; exposing the radiation-absorbing compound to radiation, thereby initiating the reaction; dissolving the radiation-absorbing compound, the inorganic acid or salt thereof, and the reactant compound, in the matrix to form a matrix mixture; and disposing the matrix mixture onto a substrate.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Embodiments of the disclosure include image recording coating, image recording medium, and methods of making each. The image-recording medium includes an image layer or coating having a calcium salt of an organic acid. Typical imaging layers including colorants (e.g., leuco dyes) are problematic in that mark(s) produced by the colorants fade upon exposure to oil, for example, oil exposure from a person's hand during handling of the image recording medium. In contrast, the image layer including the calcium salt of the organic acid is stable upon exposure to oil. The image layer can be a coating disposed onto a substrate and used in structures such as, but not limited to, paper, digital recording material, cardboard (e.g., packaging box surface), plastic (e.g., food packaging surface), and the like.

A clear mark and excellent image quality can be obtained by directing radiation energy (e.g., a 780 nm laser operating at 35 MW) at areas of the image layer on which a mark is desired. The components in the image layer used to produce the mark via a color change upon stimulation by energy can include, but is not limited to, a color former (e.g., a leuco dye), an activator (e.g., a sulphonylphenol compound), a radiation-absorbing compound, and a fixer compound. When the radiation-absorbing compound absorbs a particular radiation energy, it initiates a reaction between the color former and the activator to produce a color change (e.g., a mark). The fixer compound retards the fading of the mark due to exposure to oil, for example during handling of the image recording medium by an individual.

The radiation energy absorber functions to absorb radiation energy, convert the energy into heat, and deliver the heat to the reactants. The radiation energy may then be applied by way of an infrared laser. Upon application of the radiation energy, both the color former and the activator may become heated and mix, which causes the color former to become activated and cause a mark (color) to be produced.

Figure 1:
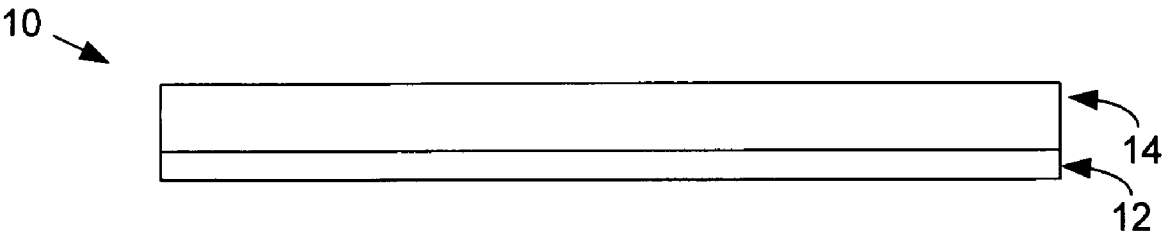
FIG. 1 illustrates an illustrative embodiment of the imaging medium.

FIG. 1 illustrates an embodiment of an imaging medium 10. The imaging medium 10 can include, but is not limited to, a substrate 12 and a layer 14. The substrate 12 can be a substrate upon which it is desirable to make a mark, such as, but not limited to, paper (e.g., labels, tickets, receipts, or stationery), overhead transparencies, a metal/metal composite, glass, a ceramic, a polymer, and a labeling medium (e.g., a compact disk (CD) (e.g., CD-R/RW/ROM) and a digital video disk (DVD) (e.g., DVD-R/RW/ROM)). In particular, the substrate 12 includes an "optical disk" which is meant to encompass audio, video, multi-media, and/or software disks that are machine readable in a CD and/or DVD drive, or the like. Examples of optical disk formats include writeable, recordable, and rewriteable disks such as DVD, DVD-R, DVD-RW, DVD+R, DVD+RW, DVD-RAM, CD, CD-ROM, CD-R, CD-RW, and the like. Other like formats can also be included, such as similar formats and formats to be developed in the future.

The layer 14 can include, but is not limited to, the matrix, the color former, the activator, the radiation-absorbing compound, the fixer compound, as well as other components typically found in the particular media to be produced.

The layer 14 may be applied to the substrate 12 via any acceptable method, such as, but not limited to, rolling, spraying, and screen-printing. In addition, one or more layers can be formed between the layer 14 and the substrate 12 and/or one or more layer can be formed on top of the layer 14. In one embodiment, the layer 14 is part of a CD or a DVD.

To form a mark, radiation energy is directed imagewise at one or more discrete areas of the layer 14 of the imaging medium 10. The form of radiation energy may vary depending upon the equipment available, ambient conditions, the desired result, and the like. The radiation energy can include, but is not limited to, infrared (IR) radiation, ultraviolet (UV) radiation, x-rays, and visible light. The radiation-absorbing compound absorbs the radiation energy and heats the area of the layer 14 to which the radiation energy impacts. The heat may cause the color former and the activator to mix. The color former and the activator may then react to form a mark (color) on certain areas of the layer 14.

Figure 2:
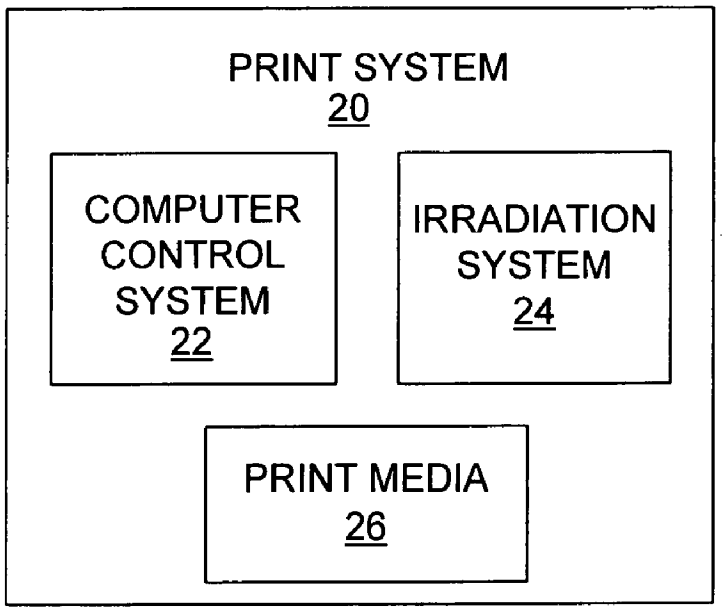
FIG. 2 illustrates a representative embodiment of a printer system.

FIG. 2 illustrates a representative embodiment of a print system 20. The print system 20 can include, but is not limited to, a computer control system 22, an irradiation system 24, and print media 26 (e.g., imaging medium). The computer control system 22 is operative to control the irradiation system 24 to cause marks (e.g., printing of characters, symbols, photos, and the like) to be formed on the print media 26. The irradiation system 24 can include, but is not limited to, a laser system, UV energy system, IR energy system, visible energy system, x-ray system, and other systems that can produce radiation energy to cause a mark to be formed on the layer 14 In addition, the print system 20 can be incorporated into a digital media system. For example, the print system 20 can be operated in a digital media system to print labels (e.g., the layer is incorporated into a label) onto digital media such as CDs and DVDs. Furthermore, the print system 20 can be operated in a digital media system to directly print onto the digital media (e.g., the layer is incorporated the structure of the digital media).

As mentioned above, the image layer can include, but is not limited to, the matrix, the color former, the activator, the radiation-absorbing compound, the fixer compound.

The matrix 16 can include compounds capable of and suitable for dissolving and/or dispersing the radiation-absorbing compound, the aromatic compound, the activator, and/or the color former. The matrix 16 can include, but is not limited to, UV curable monomers, oligomers, and pre-polymers (e.g., acrylate derivatives. Illustrative examples of UV-curable monomers, oligomers, and pre-polymers (that may be mixed to form a suitable UV-curable matrix) can include but are not limited to, polyvinyl alcohol, polyvinyl chloride, polyvinyl butyral, cellulose esters and blends such as cellulose acetate butyrate, polymers of styrene, butadiene, ethylene, poly carbonates, polymers of vinyl carbonates (e.g., CR39 (available from PPG industries, Pittsburgh), co-polymers of acrylic and allyl carbonate monomers (e.g., BX-946 (available form Hampford Research, Stratford, Conn.), hexamethylene diacrylate, tripropylene glycol diacrylate, lauryl acrylate, isodecyl acrylate, neopentyl glycol diacrylate, 2-phenoxyethyl acrylate, 2(2-ethoxy)ethylacrylate, polyethylene glycol diacrylate and other acrylated polyols, trimethylolpropane triacrylate, pentaerythritol tetraacrylate, ethoxylated bisphenol A diacrylate, acrylic oligomers with epoxy functionality, and the like.

The matrix compound 16 is about 2 wt % to 98 wt % of the layer and about 20 wt % to 90 wt % of the layer.

The fixer compound includes, but is not limited to, a calcium salt of an organic acid. The organic acid of the calcium salt can include, but is not limited to, steric acid, monobenzylphthalic acid, resinic acid, monobutylphthalic acid, phthalic acid monoesters, and combinations thereof. The fixer compound is about 5 wt % to 30 wt % of the layer, about 10 wt % to 25 wt % of the layer, about 10 wt % to 20 wt % of the layer, about 15 wt % of the layer.

The term "color former" is a color forming substance, which is colorless or one color in a non-activated state and produces or changes color in an activated state. The color former can include, but is not limited to, leuco dyes and phthalide color formers (e.g., fluoran leuco dyes and phthalide color formers as described in "The Chemistry and Applications of Leuco Dyes", Muthyala, Ramiah, ed., Plenum Press (1997) (ISBN 0-306-45459-9), incorporated herein by reference).

The color forming composition can include a wide variety of leuco dyes. Suitable leuco dyes include, but are not limited to, fluorans, phthalides, amino-triarylmethanes, aminoxanthenes, aminothioxanthenes, amino-9,10-dihydroacridines, aminophenoxazines, aminophenothiazines, aminodihydro-phenazines, aminodiphenylmethanes, aminohydrocinnamic acids (cyanoethanes, leuco methines) and corresponding esters, 2(p-hydroxyphenyl)-4,5-diphenylimidazoles, indanones, leuco indamines, hydrozines, leuco indigoid dyes, amino-2,3-dihydroanthraquinon-es, tetrahalo-p,p'-biphenols, 2(p-hydroxyphenyl)-4,5-diphenylimidazoles, phenethylanilines, phthalocyanine precursors (such as those available from Sitaram Chemicals, India), and other known leuco dye compositions. Experimental testing has shown that fluoran based dyes are one class of leuco dyes which exhibit particularly desirable properties.

In one aspect of the present invention, the leuco dye can be a fluoran, phthalide, aminotriarylmethane, or mixture thereof. Several non-limiting examples of suitable fluoran based leuco dyes include 3-diethylamino-6-methyl-7-anilinofluorane, 3-(N-ethyl-p-toluidino)-6-meth-yl-7-anilinofluorane, 3-(N-ethyl-N-isoamylamino)-6-methyl-7-anilinofluoran-e, 3-diethylamino-6-methyl-7-(o,p-dimethylanilino) fluorane, 3-pyrrolidino-6-methyl-7-anilinofluorane, 3-piperidino-6-methyl-7-anilino-fluorane, 3-(N-cyclohexyl-N-methylamino)-6-methyl-7-anilinofluorane, 3-diethylamino-7-(m-trifluoromethylanilino)fluorane, 3-dibutylamino-6-methyl-7-anilinofluorane, 3-diethylamino-6-chloro-7-anilinofluorane, 3-dibutylamino-7-(o-chloroanilino)fluorane, 3-diethylamino-7-(o-chloroanilino) fluorane, 3-di-n-pentylamino-6-methyl-7-anilinofluoran, 3-di-n-butylamino-6-methyl-7-anilinofluoran, 3-(n-ethyl-n-isopentylamino)-6-methyl-7-anilinofluoran, 3-pyrrolidino-6-methyl-7-anilinofluoran, 1(3H)-isobenzofuranone,4,5,6,7-t-etrachloro-3,3-bis[2-[4-(dimethylamino)phenyl]-2-(4-methoxyphenyl)ethenyl]-, 2-anilino-3-methyl-6-(N-ethyl-N-isoamylamino)fluorane (S-205 available from Nagase Co., Ltd), and mixtures thereof. Suitable aminotriarylmethane leuco dyes can also be used in the present invention such as tris(N,N-dimethylaminophenyl)methane (LCV); tris (N,N-diethylaminophenyl) methane (LECV); tris(N,N-di-n-propylaminophenyl)methane (LPCV); tris(N,N-di-n-butylaminophenyl)methane (LBCV); bis(4-diethylaminophenyl)-(4-diethylamino-2-methyl-phenyl) methane (LV-1); bis(4-diethylamino-2-methylphenyl)-(4-diethylamino-phenyl)methane (LV-2); tris(4-diethylamino-2-methylphenyl)methane (LV-3); bis(4-diethylamino-2-methylphenyl)(3,4-dimethoxy-phenyl)methane (LB-8); aminotriarylmethane leuco dyes having different alkyl substituents bonded to the amino moieties wherein each alkyl group is independently selected from C1-C4 alkyl; and aminotriaryl methane leuco dyes with any of the preceding named structures that are further substituted with one or more alkyl groups on the aryl rings wherein the latter alkyl groups are independently selected from C1-C3 alkyl. Other leuco dyes can also be used in connection with the present invention and are known to those skilled in the art. A more detailed discussion of some of these types of leuco dyes may be found in U.S. Pat. Nos. 3,658,543 and 6,251,571, each of which are hereby incorporated by reference in their entireties. Additional examples and methods of forming such compounds can be found in Chemistry and Applications of Leuco Dyes, Muthyala, Ramaiha, ed., Plenum Press, New York, London; ISBN: 0-306-45459-9, which is hereby incorporated by reference.

The color former is from about 3 wt % to 35 wt % of the layer and from about 20 wt % to 30 wt % of the layer.

As used herein, the term "activator" is a substance that reacts with a color former and causes the color former to alter its chemical structure and change or acquire color. The activators may include, but is not limited to, proton donors and acidic phenolic compounds (e.g., benzyl hydroxybenzoate, bisphenol-A and bisphenol-S) as well as derivatives thereof (e.g., D8™ (4-hydroxyphenyl-4'-isopropoxyphenyl sulfone), TG-SA™ (bis(4-hydroxy-3-allylphenyl)sulfone) and polyphenols. The activator is from about 1 wt % to 40 wt % of the layer and from about 3 wt % to 25 wt % of the layer.

The term "radiation-absorbing compound" (e.g., an antenna) means any radiation-absorbing compound in which the antenna readily absorbs a desired specific wavelength of the marking radiation. The radiation-absorbing compound can be a material that effectively absorbs the type of energy to be applied to the imaging medium 10 to effect a mark or color change.

The radiation-absorbing compound can act as an energy antenna, providing energy to surrounding areas upon interaction with an energy source. As a predetermined amount of energy can be provided by the radiation-absorbing compound, matching of the radiation wavelength and intensity to the particular antenna used can be carried out to optimize the system within a desired optimal range. Most common commercial applications can require optimization to a development wavelength of about 200 nm to about 900 nm, although wavelengths outside this range can be used by adjusting the radiation-absorbing compound and color forming composition accordingly.

Suitable radiation-absorbing compound can be selected from a number of radiation absorbers such as, but not limited to, aluminum quinoline complexes, porphyrins, porphins, indocyanine dyes, phenoxazine derivatives, phthalocyanine dyes, polymethyl indolium dyes, polymethine dyes, guaiazulenyl dyes, croconium dyes, polymethine indolium dyes, metal complex IR dyes, cyanine dyes, squarylium dyes, chalcogeno-pyryloarylidene dyes, indolizine dyes, pyrylium dyes, quinoid dyes, quinone dyes, azo dyes, and mixtures or derivatives thereof. Other suitable radiation-absorbing compounds can also be used and are known to those skilled in the art and can be found in such references as "Infrared Absorbing Dyes", Matsuoka, Masaru, ed., Plenum Press, New York, 1990 (ISBN 0-306434784) and "Near-Infrared Dyes for High Technology Applications", Daehne, Resch-Genger, Wolfbeis, Kluwer Academic Publishers (ISBN 0-7923-5101-0), both incorporated herein by reference.

Various radiation-absorbing compounds can act as an antenna to absorb electromagnetic radiation of specific wavelengths and ranges. Generally, a radiation antenna that has a maximum light absorption at or in the vicinity of the desired development wavelength can be suitable for use in the present disclosure. For example, the color forming composition can be optimized within a range for development using infrared radiation having a wavelength from about 720 nm to about 900 nm. Common CD-burning lasers have a wavelength of about 780 nm and can be adapted for forming images by selectively developing portions of the image layer.

Radiation-absorbing compound which can be suitable for use in the infrared range can include, but are not limited to, polymethyl indoliums, metal complex IR dyes, indocyanine green, polymethine dyes such as pyrimidinetrione-cyclopentylidenes, guaiazulenyl dyes, croconium dyes, cyanine dyes, squarylium dyes, chalcogenopyryloarylidene dyes, metal thiolate complex dyes, bis(chalcogenopyrylo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, hexafunctional polyester oligomers, heterocyclic compounds, and combinations thereof.

Several specific polymethyl indolium compounds are available from Aldrich Chemical Company and include 2-[2-[2-chloro-3-[2-(1,3-dihydro-1,3,3-trimethyl-2/-/-indol-2-ylidene)-ethylidene]-1-cyclopenten-1-yl-ethenyl]-1,3,3-trimethyl-3/-/-indolium perchlorate; 2-[2-[2-chloro-3-[2-(1,3-dihydro-1,3,3-trimethyl-2H-indol-2-ylidene)-ethylidene]-1-cyclopenten-1-yl-ethenyl]-1,3,3-trimethyl-3W-indolium chloride; 2-[2-[2-chloro-3-[(1,3-dihydro-3,3-dimethyl-1-propyl-2H-indol-2-ylidene) ethylidene]-1-cyclohexen-1-yl] ethenyl]-3,3-dimethyl-1-propylindolium iodide; 2-[2-[2-chloro-3-[(1,3-dihydro-1,3,3-trimethyl-2H-indol-2-ylidene) ethylidene]-1-cyclohexen-1-yl]ethenyl]-1,3,3-trimethylindolium iodide; 2-[2-[2-chloro-3~[(1,3-dihydro-1,3,v3-trimethyl-2H-indol-2-ylidene) ethylidene]-1-cyclohexen-1-yl]

ethenyl]-1,3,3-trimethylindolium perchlorate; 2-[2-[3-[(1,3-dihydro-3,3-dimethyl-1-propyl-2H-indol-2-ylidene) ethylidene]-2-(phenylthio)-1-cyclohexen-1-yl]ethenyl]-3,3-dimethyl-1-propylindolium perchlorate; and mixtures thereof. Alternatively, the radiation-absorbing compound can be an inorganic compound (e.g., ferric oxide, carbon black, selenium, or the like). Polymethine dyes or derivatives thereof such as a pyrimidinetrione-cyclopentylidene, squarylium dyes such as guaiazulenyl dyes, croconium dyes, or mixtures thereof can also be used in the present invention. Suitable pyrimidinetrione-cyclopentylidene infrared antennae include, for example, 2,4,6(1H,3H,5H)-pyrimidinetrione 5-[2,5-bis[(1,3-dihydro-1,1,3-dimethyl-2H-indol-2-ylidene) ethylidene]cyclopentylidene]-1,3-dimethyl-(9Cl) (S0322 available from Few Chemicals, Germany).

In another embodiment, the radiation-absorbing compound can be selected for optimization of the color forming composition in a wavelength range from about 600 nm to about 720 nm, such as about 650 nm. Non-limiting examples of suitable radiation-absorbing compound for use in this range of wavelengths can include indocyanine dyes such as 3H-indolium,2-[5-(1,3-dihydro-3,3-dimethyl-1-propyl-2H-indol-2-ylidene)-1,3-pentadienyl]-3,3-dimethyl-1-propyl-, iodide) (Dye 724 Amax 642 nm), 3H-indolium,1-butyl-2-[5-(1-butyl-1,3-dihydro-3,3-dimethyl-2H-indo!-2-ylidene)-1,3-pentadienyl]-3,3-dimethyl-perchlorate (Dye 683 $A_{max}$ 642 nm), and phenoxazine derivatives such as phenoxazin-5-ium, 3,7-bis(diethylamino)-perchlorate (oxazine 1 $A_{max}$=645 nm). Phthalocyanine dyes having an $A_{max}$ of about the desired development wavelength can also be used such as silicon 2,3-napthalocyanine bis(trihexylsilyloxide) and matrix soluble derivatives of 2,3-napthalocyanine (both commercially available from Aldrich Chemical); matrix soluble derivatives of silicon phthalocyanine (as described in Rodgers, A. J. et al., 107 J. Phys. Chem. A 3503-3514, May 8, 2003), and matrix soluble derivatives of benzophthalocyanines (as described in Aoudia, Mohamed, 119 J. Am. Chem. Soc. 6029-6039, Jul. 2, 1997); phthalocyanine compounds such as those described in U.S. Pat. Nos. 6,015,896 and 6,025,486, which are each incorporated herein by reference; and Cirrus 715 (a phthalocyanine dye available from Avecia, Manchester, England having an $A_{max}$=806 nm).

In another embodiment, laser light having blue and indigo wavelengths from about 300 nm to about 600 nm can be used to develop the color forming compositions. Therefore, the present disclosure can provide color forming compositions optimized within a range for use in devices that emit wavelengths within this range. Recently developed commercial lasers found in certain DVD and laser disk recording equipment provide for energy at a wavelength of about 405 nm. Thus, using appropriate radiation-absorbing compound can be suited for use with components that are already available on the market or are readily modified to accomplish imaging. Radiation-absorbing compounds that can be useful for optimization in the blue (~405 nm) and indigo wavelengths can include, but are not limited to, aluminum quinoline complexes, porphyrins, porphins, and mixtures or derivatives thereof. Non-limiting specific examples of suitable radiation antenna can include 1-(2-chloro-5-sulfophenyl)-3-methyl-4-(4-sulfophenyl)azo-2-pyrazolin-5-one disodium salt (X max=400 nm); ethyl 7-diethylaminocoumarin-3-carboxylate (X max=418 nm); 3,3'-diethylthiacyanine ethylsulfate (X max=424 nm); 3-allyl-5-(3-ethyl-4-methyl-2-thiazolinylidene) rhodanine (X max=430 nm) (each available from Organica Feinchemie GmbH Wolfen), and mixtures thereof. Non-limiting specific examples of suitable aluminum quinoline complexes can include tris(8-hydroxyquinolinato)aluminum (CAS 2085-33-8) and derivatives such as tris(5-cholor-8-hydroxyquinolinato)aluminum (CAS 4154-66-1), 2-(4-(1-methyl-ethyl)-phenyl)-6-phenyl-4H-thiopyran-4-yl idene)-propanedinitril-1,1-dioxide (CAS 174493-15-3), 4,4'-[1,4-phenylenebis(1,3,4-oxadiazole-5,2-diyl)]bis N,N-diphenyl benzeneamine (CAS 184101-38-0), bis-tetraethylammonium-bis(1,2-dicyanodithiolto)-zinc(II) (CAS 21312-70-9), 2-(4,5-dihydronaphtho[1,2-d]-1,3-dithiol-2-ylidene)-4,5-dihydro-naphtho[1,2-d]1,3-dithiole, all available from Syntec GmbH. Non-limiting examples of specific porphyrin and porphyrin derivatives can include etioporphyrin 1 (CAS 448-71-5), deuteroporphyrin IX 2,4 bis ethylene glycol (D630-9) available from Frontier Scientific, and octaethyl porphrin (CAS 2683-82-1), azo dyes such as Mordant Orange CAS 2243-76-7, Merthyl Yellow (60-11-7), 4-phenylazoaniline (CAS 60-09-3), Alcian Yellow (CAS 61968-76-1), available from Aldrich chemical company, and mixtures thereof.

The radiation-absorbing compound is from about 0.01 wt % to 10 wt % of the layer and from about 0.1 wt % to 3 wt % of the layer.

EXAMPLE 1

Preparation of color former particles for the color former phase (BK400/m-T/Cirrus 715 Alloy): About 10 g of m-terphenyl (accelerator) was melted in a beaker, and the melt was heated to about 110° C. About 100 g of BK400 was added in small increments to the melt upon constant stirring. The added BK400 is a leuco-dye (2'-anilino-3'-methyl-6'-(dibutylamino)fluoran) available from Nagase Corporation, the structure of which is set forth below as Formula 1:

Formula 1

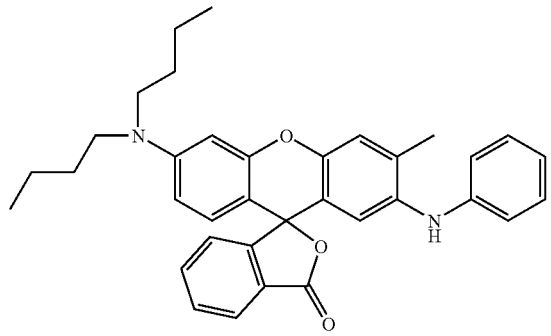

The temperature of the mixture was increased up to about 170° C. to 180° C. Stirring was continued until complete dissolution of BK400 in the melt (usually takes about 10 to 15 min) was obtained to form an accelerator/leuco dye solution. Next, about 1.8 g of Cirrus-715 (radiation-absorber IR dye) was added to the melt upon constant stirring. Heating and stirring was continued for about two to three additional minutes until the Cirrus-715 was completely dissolved in the melt to form a leuco dye/antenna/accelerator alloy (eutectic). The temperature of the leuco-dye/antenna/accelerator alloy was kept to below about 190° C., and was then poured into a pre-cooled freezer tray lined with aluminum foil. The solidified melt was milled into a coarse powder, and then the pre-milled powder was milled in aqueous dispersion (~15% solids) using Netzsch Mini-Zeta Bead mill with 1 mm zirconia beads. The milling was stopped when average particle diameter was reduced to a value of about 0.4 μm to about 0.6 μm. The particles in the slurry were then collected and freeze-dried, resulting in color former particles that will become the color former phase.

Preparation of the lacquer-soluble Cirrus 715 Alloy (m-T/Cirrus 715 Alloy(50/50)): About 50 g of m-Terphenyl were melted in a beaker. When the temperature of the melt reached about 140-150° C., about 50 g of Cirrus 715 were stirred into the melt. The melt was stirred with temperature maintained around 140-150° C. until complete dissolution of Cirrus 715. Then the melt was cooled down to ambient temperature. The solidified melt was milled into a coarse powder.

Preparation of amorphous Developer: About 50 g of N-p-tolylsulfonyl-N'-3-(p-tolylsulfonyloxy)phenylurea (also known as Pergafast 201 by "Ciba Specialty Chemicals") were heated until complete melting. The melt was cooled down to solid glassy state and milled in aqueous dispersion (about 15% solids) using Netzsch Mini-Zeta Bead mill with 1.5 mm zirconia beads. The milling was stopped when average particle diameter was reduced to a value of about 1.0 μm to about 1.6 μm. The particles in the slurry were collected and freeze-dried.

Preparation of the UV-curable developer phase (continuous phase): About 20 g of the milled amorphous Pergafast-201 powder, of m-Terphenyl/Cirrus 715(50:50) Alloy, "Yoshinox SR" (Bis(2-methyl-4-hydroxy-5-tert-butylphenyl) sulfide available from TCI America) and Irgacure-1330 (available from "Ciba Specialty Chemicals"), and the calcium salts of (Formula 2) of this disclosure, were dissolved/dispersed in XP155-049/10 UV-lacquer (available from "Nor-Cote International") (mixture or packet of UV-curable acrylate monomers and oligomers) to form the lacquer/antenna/developer solution or IR(780 nm)-sensitized/UV-curable developer phase.

Formula 2

Preparation of color forming composition (fine dispersion): A UV-curable paste was prepared by mixing (a) about 25 g of the finely milled color former particles with (b) about 75 g of the UV-curable developer phase using following composition.

| | | |
|---|---|---|
| *XP155-049/10 Lacquer | 46.73% | 23.365 |
| Sulfonyldiphenol | 3.50% | 1.75 |
| Calcium monozenzylphthalate | 10.40% | 5.2 |
| Irgacure-1300 | 6.00% | 3 |
| m-T/715 Alloy (50/50) | 1.70% | 0.85 |
| BK 400 alloy | 31.67% | 15.835 |
| Total | 100.00% | 50 |

The paste was screen printed onto a substrate at a thickness of approximately about 6 μm to about 8 μm to form an imaging medium including an imaging coating. The coating on the medium was then UV cured by mercury lamp. The resulting coating was transparent with noticeable dark-yellowish hue. Direct marking on the UV cured imaging coating was carried out using a 45 mW laser having a wavelength of about 780 nm. A mark of approximately 20 μm by 45 μm was produced using various durations of energy application from about 40 μsec to about 100 μsec. Upon application of appropriate energy, the color forming composition of the imaging coating changed in color from the greenish transparent appearance to a black color.

The compositions were tested for stability using exposure to 3 canola oil rubs with cotton swab, and measurement in loss of optical intensity measured as ΔL* value after 72 h. The table shows comparison of the examples of stability as measured by loss in optical density with and without calcium stabilizer coatings. Clearly, the coating with calcium salts are less prone to fade by oil and archival storage.

| | No calcium salt | Calcium monobenzylphthalate |
|---|---|---|
| Loss of ΔL* 72 h | 29% | 3% |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. An image recording coating comprising:

a substrate having a layer disposed thereon, wherein the layer includes:

a matrix;

a radiation-absorbing compound;

an activator;

a color former, wherein the activator and color former are designed mix to form a dark mark; and a fixer compound, wherein the fixer compound is chosen to retard fading of the dark mark upon exposure to an oil, wherein the fixer compound includes a calcium salt of an organic acid, and wherein the organic acid is selected from one the following: monobutylphthalic acid, monoalkylphthalic acid, and combinations thereof.

2. The image recording coating of claim 1, wherein the layer includes: matrix in an amount of about 10 to 80 weight percent of the layer, the radiation-absorbing compound in an amount of about 1 to 5 weight percent of the layer, the activator in an amount of about 3 to 30 weight percent of the layer, the color former in an amount of about 3 to 35 weight percent of the layer, and a fixer compound in an amount of about 5 to 30 weight percent of the layer.

3. The image recording coating of claim 1, wherein the substrate is selected from a paper medium, a transparency, a compact disk (CD), and a digital video disk (DVD).

4. The image recording coating of claim 1, wherein the substrate is an optical disk format selected from one the following: DVD, DVD-R, DVD-RW, DVD+R, DVD+RW, DVD-RAM, CD, CD-ROM, CD-R, and CD-RW.

5. The image recording coating of claim 1, wherein the substrate is selected from cardboard and plastic.

6. A method for preparing a recording medium, the method comprising:

providing a matrix, a radiation-absorbing compound, an activator, a color former, and a fixer compound;

mixing the radiation-absorbing compound, the activator, the color former, and the fixer compound, in the matrix to form a matrix mixture; and disposing the matrix mixture onto a substrate, wherein the activator and color former are adapted to form a mark, and wherein the fixer compound is chosen to retard fading of the dark mark upon exposure to an oil, wherein the fixer compound includes a calcium salt of an organic acid, and wherein the organic acid is selected from one the following: monobutylphthalic acid, monoalkylphthalic acid, and combinations thereof.

7. The method of claim 6, wherein the substrate is selected from a paper medium, a transparency, a compact disk (CD), and a digital video disk (DVD).

8. The method of claim 6, wherein the substrate is an optical disk format selected from one the following: DVD, DVD-R, DVD-RW, DVD+R, DVD+RW, DVD-RAM, CD, CD-ROM, CD-R, and CD-RW.

9. An image recording coating comprising:

a substrate having a layer disposed thereon, wherein the layer includes:

a matrix;

a radiation-absorbing compound;

a phenolic developer;

a calcium salt of an organic acid, wherein the organic acid is selected from one the following: monobutylphthalic acid, monoalkylphthalic acid, resinic acid, and combinations thereof;

a leuco dye, wherein the layer includes a color change that is produced when the radiation-absorbing compound absorbs radiation and initiates a reaction between the phenolic acid and the calcium salts of the organic acid and the leuco dye.

10. The image recording coating of claim 9, wherein the substrate is selected from a paper medium, a transparency, a compact disk (CD), and a digital video disk (DVD).

11. The image recording coating of claim 9, wherein the substrate is an optical disk format selected from one the following: DVD, DVD-R, DVD-RW, DVD+R, DVD+RW, DVD-RAM, CD, CD-ROM, CD-R, and CD-RW.

12. The image recording coating of claim 9, wherein the substrate is selected from cardboard and plastic.

13. A method for preparing a recording medium, the method comprising:

providing a matrix, a radiation-absorbing compound, a phenolic compound and calcium salt of an organic acid, and a leuco dye, wherein the radiation-absorbing compound absorbing radiation and initiating a reaction between the phenolic compound, and calcium salt of the organic acid, and the leuco dye to produce a color change, and wherein the organic acid is selected from one the following: monobutylphthalic acid, monoalkylphthalic acid, resinic acid, and combinations thereof;

exposing the radiation-absorbing compound to radiation, thereby initiating the reaction;

dissolving the radiation-absorbing compound, the inorganic acid or salt thereof, and the reactant compound, in the matrix to form a matrix mixture; and disposing the matrix mixture onto a substrate.

14. The method of claim 13, wherein the substrate is selected from a paper medium, a transparency, a compact disk (CD), and a digital video disk (DVD).

15. The method of claim 13, wherein the substrate is an optical disk format selected from one the following: DVD, DVD-R, DVD-RW, DVD+R, DVD+RW, DVD-RAM, CD, CD-ROM, CD-R, and CD-RW.

16. The image recording coating of claim 1, wherein the organic acid is resinic acid.

17. An image recording coating comprising:

a substrate having a layer disposed thereon, wherein the layer includes:

a matrix;

a radiation-absorbing compound;

a phenolic developer;

a color former, wherein the activator and color former are designed mix to form a dark mark; and a fixer compound, wherein the fixer compound is chosen to retard fading of the dark mark upon exposure to an oil, wherein the fixer compound includes a calcium salt of an organic acid, and wherein the organic acid is selected from one the following: monobutylphtalic acid, monoalkylphtalic acid, resin acid, and combinations thereof.

18. The image recording coating of claim 17, wherein the substrate is selected from a paper medium, a transparency, a compact disk (CD), and a digital video disk (DVD).

19. The image recording coating of claim 17, wherein the substrate is an optical disk format selected from one the following: DVD, DVD-R. DVD-RW, DVD+R, DVD+RW, DVD-RAM, CD, CD-ROM, CD-R, and CD-RW.

20. The image recording coating of claim 17, wherein the substrate is selected from cardboard and plastic.

21. A method for preparing a recording medium, the method comprising:

providing a matrix, a radiation-absorbing compound, phenolic developer, a color former, and a fixer compound;

mixing the radiation-absorbing compound, the phenolic developer, the color former, and the fixer compound, in the matrix to form a matrix mixture; and disposing the matrix mixture onto a substrate, wherein the phenolic developer and color former are adapted to form a mark, and wherein the fixer compound is chosen to retard fading of the dark mark upon exposure to an oil, wherein the fixer compound includes a calcium salt of an organic acid, and wherein the organic acid is selected from one the following: monobutylphtalic acid, monoalkylphtalic acid, resinic acid and combinations thereof.

22. The method of claim 21, wherein the substrate is an optical disk format selected from one the following: DVD, DVD-R, DVD-RW, DVD+R, DVD+RW, DVD-RAM, CD, CD-ROM, CD-R, and CD-RW.

23. The method of claim 21, wherein the substrate is selected from a paper medium, a transparency, a compact disk (CD), and a digital video disk (DVD).

24. The method of claim 6, wherein the substrate is selected from cardboard and plastic.

25. The method of claim 13, wherein the substrate is selected from cardboard and plastic.

* * * * *

UNITED STATES PATENT AND TRADEMARK OFFICE

CERTIFICATE OF CORRECTION

PATENT NO. : 7,314,704 B2
APPLICATION NO. : 11/256852
DATED : January 1, 2008
INVENTOR(S) : Makarand P. Gore It is certified that error appears in the above-identified patent and that said Letters Patent is hereby corrected as shown below:

In column 7, line 25, delete "2H-indo!" and insert -- 2H-indol --, therefor.

In column 8, line 3, delete "5-cholor-8" and insert -- 5-choloro-8 --, therefor.

In column 8, line 5, delete "4-yl idene" and insert -- 4-ylidene --, therefor.

In column 10, line 52, in Claim 1, after "one" insert -- of --.

In column 10, line 64, in Claim 3, after "from" insert -- the group consisting of --.

In column 10, line 67, in Claim 4, delete "one the" and insert -- the group --, therefor.

In column 11, line 1, in Claim 4, delete "following" and insert -- consisting of --, therefor.

In column 11, line 2, in Claim 4, after "CD-R," insert -- HD-DVD, Blu Ray, DVD, --.

In column 11, line 19, in Claim 6, after "one" insert -- of --.

In column 11, line 26, in Claim 8, delete "one the following" and insert -- the group consisting of --, therefor.

In column 11, line 28, in Claim 8, after "CD-R," insert -- HD-DVD, Blu Ray, DVD, --.

In column 11, line 37, in Claim 9, after "one" insert -- of --.

In column 11, line 46, in Claim 10, after "from" insert -- the group consisting of --.

In column 11, lines 49-50, in Claim 11, delete "one the following" and insert -- the group consisting of --, therefor.

Signed and Sealed this
Twenty-fourth Day of May, 2011

David J. Kappos

David J. Kappos
*Director of the United States Patent and Trademark Office*

In column 11, line 51, in Claim 11, after “CD-R,” insert -- HD-DVD, Blu Ray, DVD, --.

In column 11, line 64, in Claim 13, after “one” insert -- of --.

In column 12, line 6, in Claim 14, after “from” insert -- the group consisting of --.

In column 12, line 9, in Claim 15, delete “one the following” and insert -- the group consisting of --, therefor.

In column 12, line 11, in Claim 15, after “CD-R,” insert -- HD-DVD, Blu Ray, DVD, --.

In column 12, lines 12-13, Claim 16, delete “16. The image recording coating of claim 1, wherein the organic acid is resinic acid.”.

In column 12, line 27, in Claim 17, after “one” insert -- of --

In column 12, line 27, in Claim 17, delete “monobutylphtalic” and insert -- monobutylphthalic --, therefor.

In column 12, line 28, in Claim 17, delete “monoalkylphtalic” and insert -- monoalkylphthalic --, therefor.

In column 12, line 28, in Claim 17, delete “resin” and insert -- resinic --, therefor.

In column 12, line 33, in Claim 19, after “one” insert -- of --.

In column 12, line 34, in Claim 19, after “DVD-R” delete “.” and insert -- , --, therefor.

In column 12, line 52, in Claim 21, after “one” insert -- of --.